US006938845B2

(12) United States Patent
Galanty

(10) Patent No.: US 6,938,845 B2
(45) Date of Patent: Sep. 6, 2005

(54) TWIN-SHAFT COMMINUTOR HAVING DISSIMILAR SIZED CUTTERS

(75) Inventor: William B. Galanty, Short Hills, NJ (US)

(73) Assignee: Franklin Miller, Inc., Livingston, NJ (US)

( * ) Notice: Subject to any disclaimer, the term of this patent is extended or adjusted under 35 U.S.C. 154(b) by 181 days.

(21) Appl. No.: 10/254,034

(22) Filed: Sep. 24, 2002

(65) Prior Publication Data

US 2003/0089806 A1 May 15, 2003

Related U.S. Application Data

(60) Provisional application No. 60/324,446, filed on Sep. 24, 2001.

(51) Int. Cl.[7] ..... B02B 1/00; B02B 5/02; B02C 11/08; B02C 21/00; B02C 23/18

(52) U.S. Cl. ..... 241/46.06; 241/166; 241/222; 241/236; 241/294

(58) Field of Search ..... 241/46.06, 166, 241/222, 236, 294

(56) References Cited

U.S. PATENT DOCUMENTS 2,292,901 A * 8/1942 Schmitz, Jr. ..... 241/30
2,894,697 A 7/1959 Panning et al.
2,903,193 A * 9/1959 Anderson ..... 241/73
3,396,914 A 8/1968 Liebman
3,596,842 A 8/1971 Barber
4,418,873 A * 12/1983 Lutz et al. ..... 241/294
4,961,540 A 10/1990 Wiesemann
5,275,342 A * 1/1994 Galanty ..... 241/73
5,406,865 A 4/1995 Galanty
5,609,307 A * 3/1997 Rota ..... 241/73
5,915,636 A * 6/1999 Caballero ..... 241/73
6,176,443 B1 1/2001 Boyd
6,241,170 B1 6/2001 St. Clair
RE37,349 E * 9/2001 Chambers, Sr. et al. . 241/46.02
6,332,984 B1 12/2001 Boyd et al.

* cited by examiner

*Primary Examiner*—Derris H. Banks
*Assistant Examiner*—Jason Y Pahng
(74) *Attorney, Agent, or Firm*—McCarter & English, LLP

(57) ABSTRACT

A sewage cleaning and comminuting system is provided with a pair of dissimilar sized cutter stacks that extends across an influent channel which intercepts all solids too large to pass there through. The dissimilar sized cutter stacks are capable of grinding large and round shaped objects. The cutter stacks rotate at dissimilar speeds and require less energy to grind solids than other grinders having similar sized grinders rotating at the same speed. The system includes an integrated cleaning assembly whereby debris accumulated between the cutter disks is removed as the cutter disks rotate. Embodiments are provided including grinders that employ three and four shafts. Another embodiment is directed to an improved cutter disk. Yet another embodiment includes an auger screen assembly used in conjunction with the comminuting system to remove solids from the effluent stream.

17 Claims, 11 Drawing Sheets

TWIN-SHAFT COMMINUTOR HAVING DISSIMILAR SIZED CUTTERS

CROSS REFERENCE TO RELATED APPLICATIONS

This is a 111(a) application relating to provisional U.S. Application Ser. No. 60/324,446 filed on Sep. 24, 2001.

FIELD OF THE INVENTION

The present invention relates to a comminutor apparatus having dissimilar sized cutters for enhancing flow capacity and increasing the efficiency of solids reduction, while reducing the amount of energy required for a higher solids throughput.

BACKGROUND OF THE INVENTION

Twin-shaft type comminutors for the reduction of particle size of solid waste material to small particles by shearing, shredding and crushing are well known in the prior art (see, for instance, U.S. Pat. Nos. 5,406,865 and 5,275,342 to Galanty). Typically, such comminutors employ a pair of counter-rotating parallel shafts having sets of cutter disks and spacers fixedly mounted on each shaft, wherein the cutter disks and spacers intermesh at a close clearance with one another. More particularly, the cutting/shearing tips of each cutter disk rotate in close proximity to their opposing spacer to create a cutting and shearing action, the cutter disk sets rotating at a differential speed.

While the comminutors discussed above have been commercially successful for many years, the intermeshed cutter stacks employed thereby do present an inherent problem in that the close spacing of the intermeshed disks leads to blockage of the incoming solid debris and to a reduction in liquid throughput. One attempt to solve this problem involves the use of a larger comminutor (i.e., one large enough to inhibit solids blockage and to achieve the desired liquid throughput). Such a solution is oftentimes not practical due to increased manufacturing costs and/or power consumption.

Other problems with the prior art twin-shaft wastewater comminutors involve their limited ability to feed or grab round or large objects, which are repelled by the cutters or which simply skip across the tops of the two similarly sized cutter stacks. To partially remedy this situation, it has been proposed to increase the width of the input opening of such comminutors, as well as the throat opening size between the cutter stacks. Because the cutter stacks still have relatively small diameters, this proposed solution does not adequately address the problems associated with the feeding of large, round or irregular shapes of waste material.

Another proposed solution involves providing the comminutors with larger diameter cutter disks and shafts which therefore have more space between the cutter disks. The problem with this approach has been that it necessitates the use of larger motors and drives because of the larger cutter disk diameters, which result in the reduction of force at the shredding tip created by its added distance from the center line of the shaft. As all components get larger to support the additional torque, the comminutor becomes more expensive and less efficient.

Yet another solution has been the addition of auxiliary solids diverting screens to divert solids to the cutter disks while allowing the unimpeded flow of liquid therethrough. This design has problems with efficient delivery of solids to the cutters, operational problems and the additional complication of auxiliary screening devices.

Accordingly, there remains a need for a comminutor without the addition of complex auxiliary screening devices and drive components, or the increased power requirements of increasing the cutter disk size of typical comminution units.

In the foregoing circumstances, it is an object of the present invention to provide comminutor with a design intrinsically open to liquid flow.

Another object of the present invention is to provide a comminutor (shredder) that reduces the amount of energy required to shred and grind solids.

A still further object of the present invention is to provide a comminutor (shredder) that eliminates the need for additional rotating shafts, drives or screen diverters in order to handle high liquid flows.

Yet another object of the present invention is to provide a comminutor (shredder) that is capable of handling large or round shaped objects without having a deleterious affect on its durability and/or efficiency.

SUMMARY OF THE INVENTION

The present invention relates to an apparatus for mechanically shearing and breaking apart solid materials in a waste water effulent stream. More particularly, the improvement involves a comminutor system having at least two rotating shafts stacked with cutter disks having inter-meshing cutter tips. The diameter of one cutter stack is dissimilar to the diameter of an adjacent cutter stack. Also, the rotational speed of one cutter stack is dissimilar to that of an adjacent cutter stack. Various embodiments including comminutors having twin and multiple shaft grinding units are provided in accordance with the present invention.

A modified cutter disk employed by the comminutor is also provided. The modified cutter disk is an improved cutter disk having a plurality of studs and apertures disposed on and through the cutter disk face. The studs are disposed concentrically on, and project from, the disk face in order provide rigid support for an adjacent cutter disk and to aid in the shredding and grinding operation of the comminutor. The plurality of apertures are disposed through the cutter disk face between the cutter disk hub and cutter disk rim. The apertures reduce friction by allowing solid materials a path to pass through the comminutor. The studded spoked cutter disk may be used with all embodiments of the present invention.

Another embodiment of the present invention provides an integral cleaning system for removing debris from the cutter disks to increase flow. The integral cleaning system utilizes a comb having a plurality of teeth that interleave between the cutter disks. The teeth remove the debris adhering within the spaces between the cutter disks. The integral cleaning system may be used with all embodiments of the present invention.

Yet another embodiment of the present invention includes an auger screen assembly being placed in cooperation with a twin-shaft comminutor for the purpose of removing solid matter passing through the comminutor system. The comminutor system of the present invention lends itself to twin-shaft embodiments, as well as multi-shaft embodiments. Moreover, both twin-shaft and other multi-shaft embodiments can be used in conjunction with the auger screen assembly to facilitate the removal of solid particles from waste water effluent streams.

BRIEF DESCRIPTION OF THE DRAWINGS

Further objects, features and advantages of the present invention will become apparent upon the consideration of the following detailed description of an exemplary embodiment considered in conjunction with the accompanying drawings, in which.

DETAILED DESCRIPTION OF THE EXEMPLARY EMBODIMENT

Figure 1:
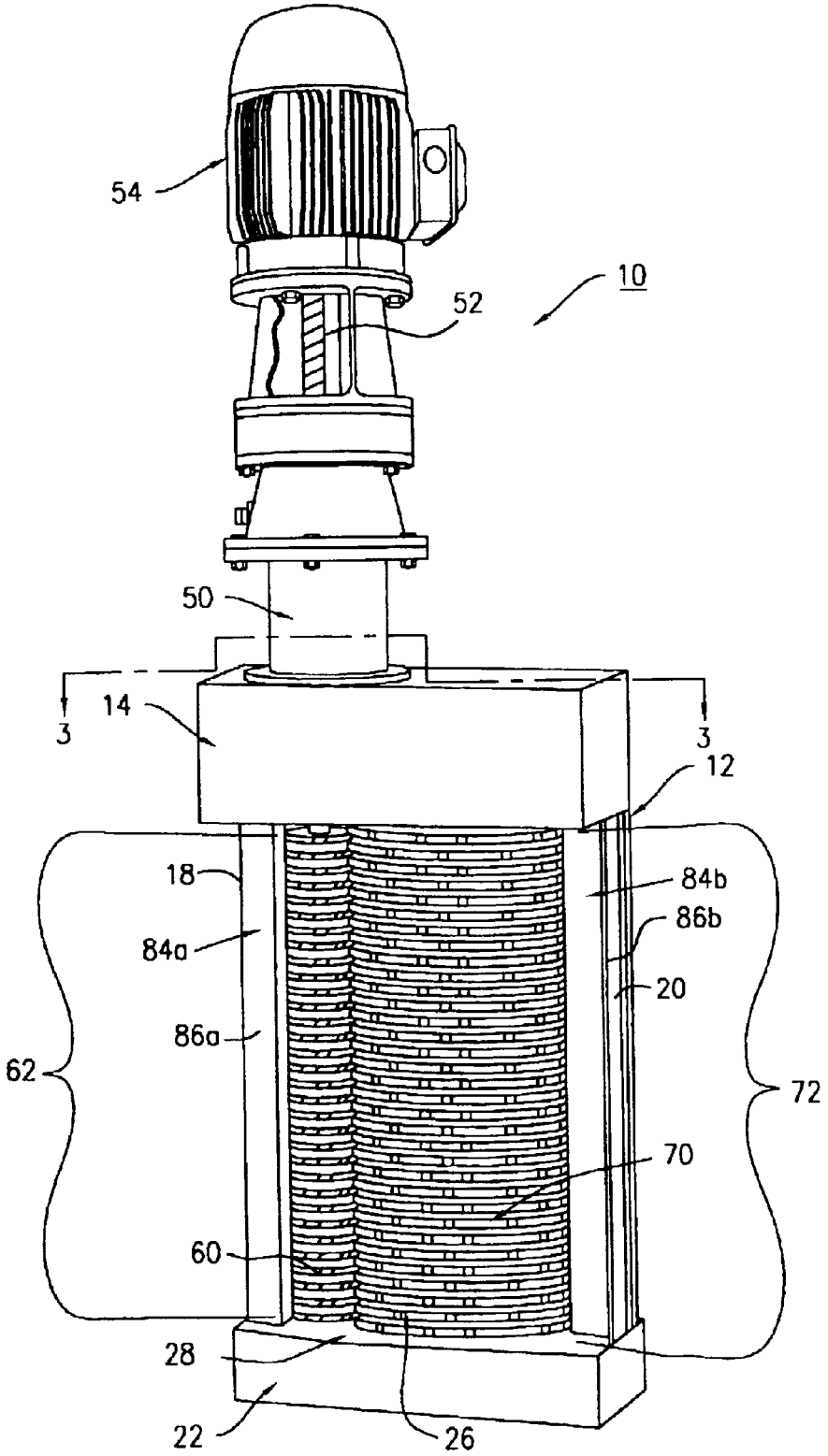
FIG. 1 is a front perspective view of a twin-shaft comminutor constructed in accordance with one embodiment of the present invention, a portion of the comminutor being broken away to facilitate consideration and discussion.
Figure 2:
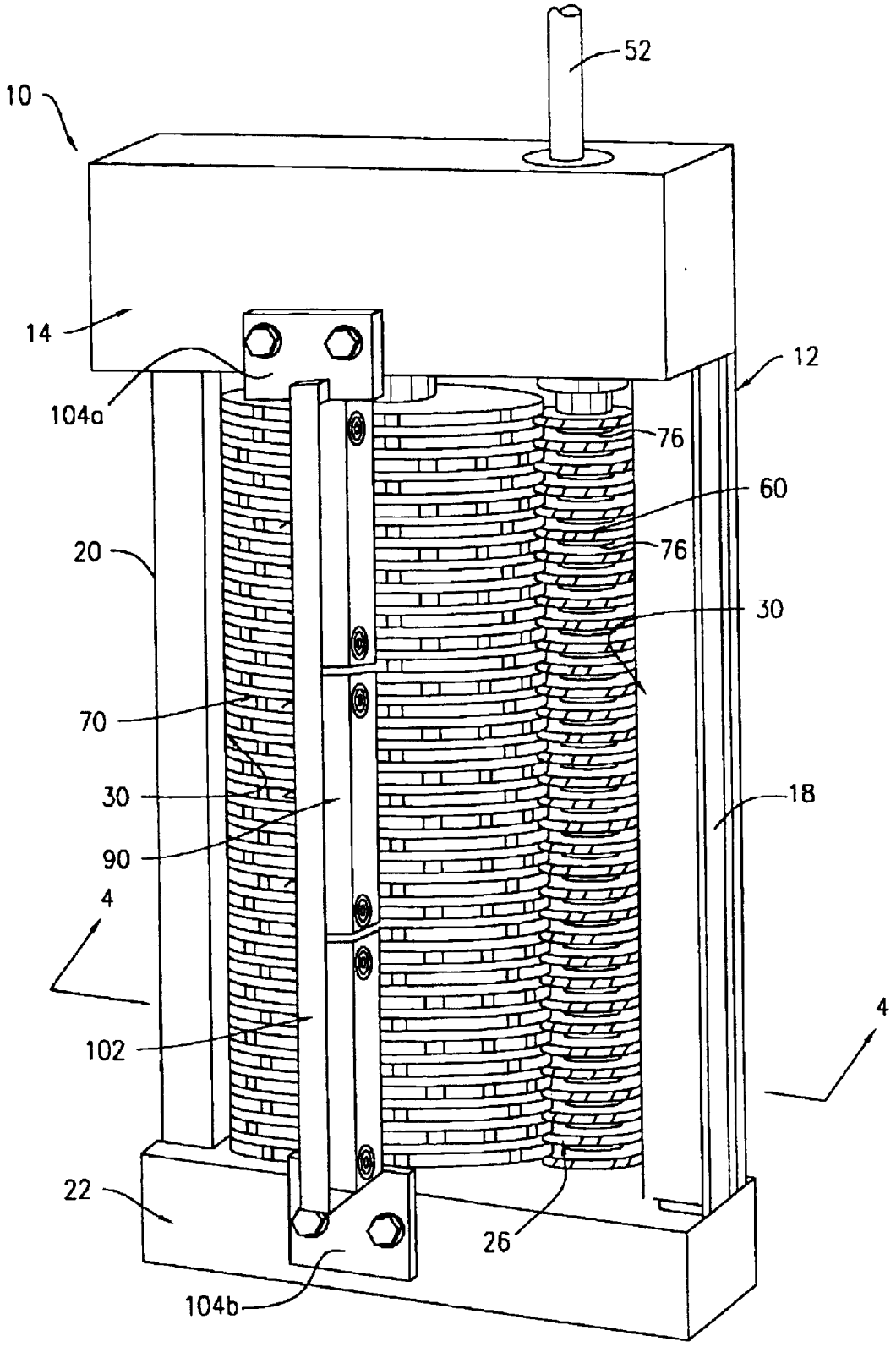
FIG. 2 is a partial rear perspective view of the twin-shaft comminutor shown in FIG. 1.
Figure 3:
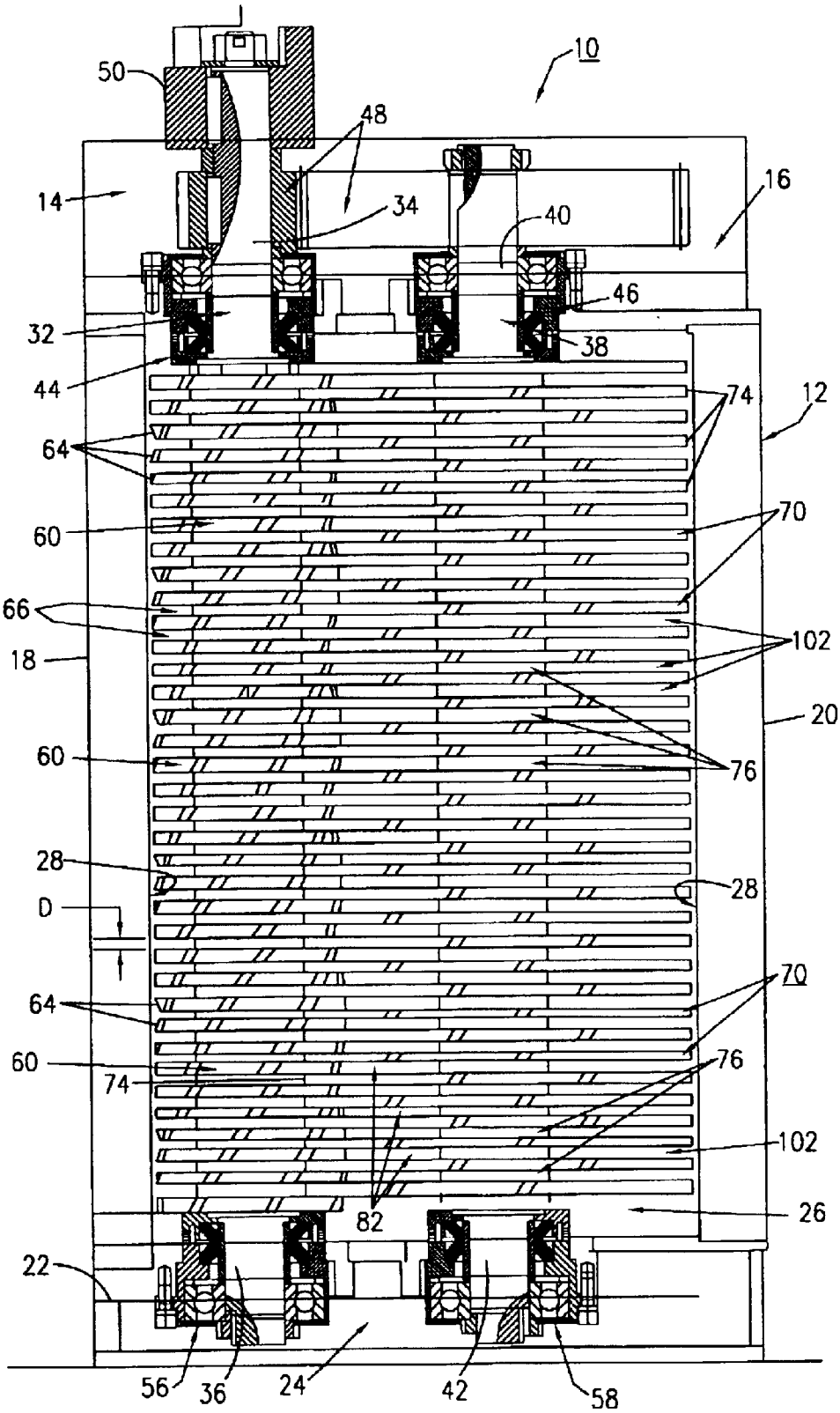
FIG. 3 is a cross-sectional view of the twin-shaft comminutor of FIG. 1 taken along section line 3—3 and looking in the direction of the arrows.

Referring to FIGS. 1, 2 and 3, a comminutor 10 includes a substantially rectangularly-shaped housing 12 defined by a top section 14, having a top drive housing 16 (see FIG. 3); side walls 18 and 20; and a bottom base section 22, having a bottom drive housing 24 (see FIG. 3). The housing 12 also includes a centrally located drive housing 26, a front opening 28 for receiving an in-flow of waste material liquid and a rear opening 30 for discharging an outflow of waste material. The drive housing 26 is used for supporting a drive shaft 32, having an upper end 34 and a lower end 36, and a driven shaft 38, having an upper end 40 and a lower end 42.

With particular reference to FIG. 3, the top drive housing 16 includes an upper drive bearing-seal cartridge 44 and an upper driven bearing-seal cartridge 46. The upper driver bearing-seal cartridge 44 receives the upper end 34 of the drive shaft 32, while the upper driven bearing-seal cartridge 46 receives the upper end 40 of the driven shaft 38. A gear train 48 is also attached and mounted to the upper ends 34 and 40 of shafts 32 and 38, respectively, as an assembly with the drive coupling 50. The drive coupling 50 is connected to a gear reducer 52 and a motor 54 (see FIG. 1), which typically has a horsepower rating in a range of about 3 to 5 Hp.

While still referring to FIG. 3, the bottom drive housing 24 includes a lower drive bearing-seal cartridge 56 and a lower driven bearing-seal cartridge 58. The lower drive bearing-seal cartridge 56 receives the lower end 36 of the driver shaft 32, while the lower driven bearing-seal cartridge 58 receives the lower end 42 of the driven shaft 38.

Referring once again to FIGS. 1, 2 and 3, the portion of the drive shaft 32 within the drive housing 26 includes multiple sets of unitary cutter body members 60 as described in U.S. Pat. No. 5,275,342, the entire disclosure of which is incorporated herein by reference. The unitary cutter body members 60 cooperate to form a first cutter stack 62. Alternatively, the first cutter stack 62 could be made of a plurality of individual cutter disks (not shown) separated by and interspersed with individual spacer members (not shown).

As illustratively shown in FIG. 3, six unitary cutter body members 60 are mounted on drive shaft 32. Each of the cutter body members 60 includes a plurality of cutting tips 64 separated by a distance (D) between adjacent cutting tips 64. The resulting gaps between the adjacent cutting tips 64 form a series of small open areas 66 through which small particles of the solid waste material can flow.

Referring still to FIG. 3, the portion of the driven shaft 38 within the drive housing 26 includes a plurality of cutter disks 70 mounted on the driven shaft 38 to form a second cutter stack 72. Each of the cutter disks 70 includes a plurality of cutting tips 74. The cutter disks 70 are separated and interspersed by individual spacer members 76 along the axial length of the shaft 38. Alternatively, the second cutter stack 72 could be made of multiple sets of unitary cutter body members (not shown), similar to the unitary cutter body members 60 described hereinabove.

Figure 4:
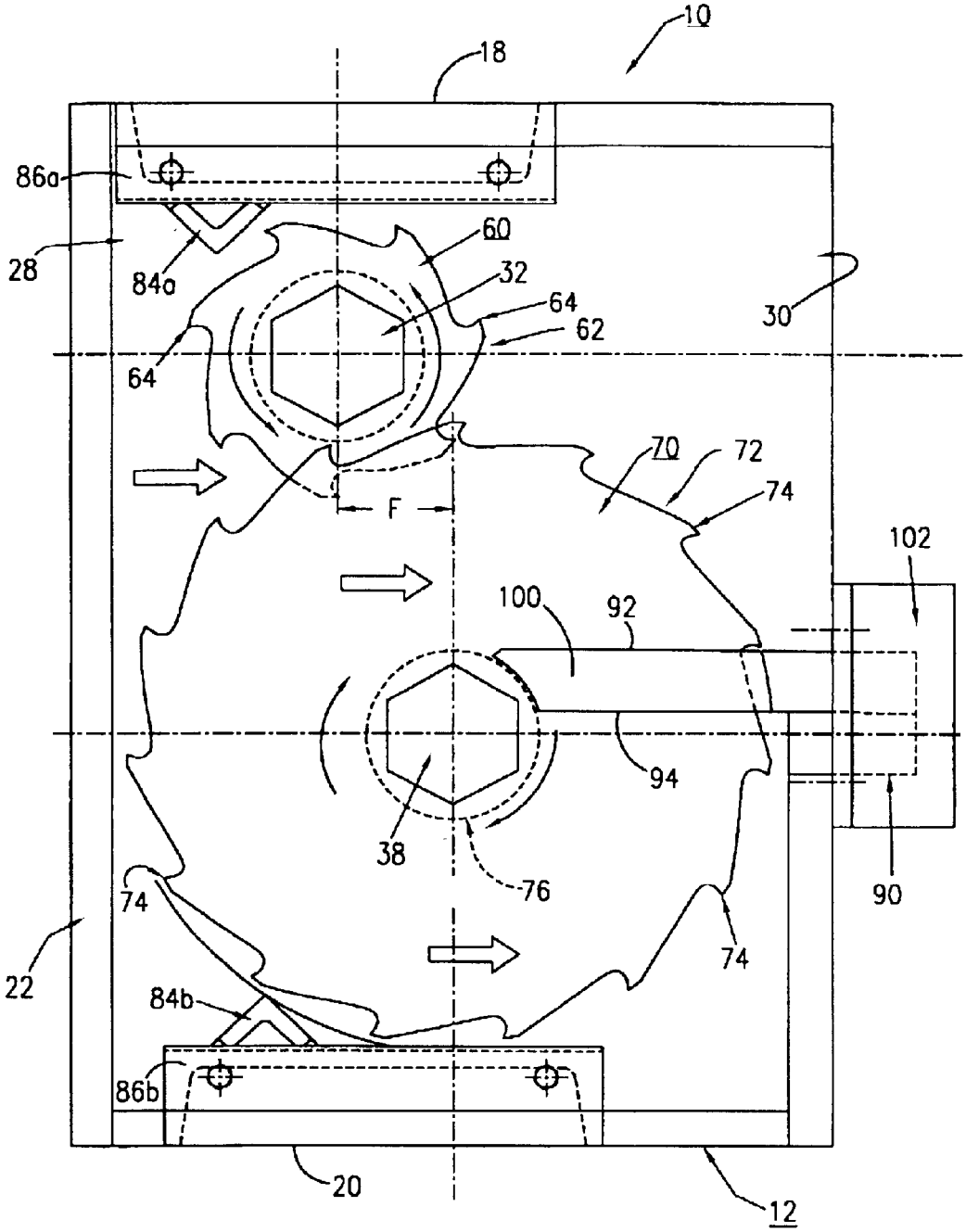
FIG. 4 is a cross-sectional view of the twin-shaft comminutor of FIG. 2 taken along section line 4—4 and looking in the direction of the arrows.
Figure 5:
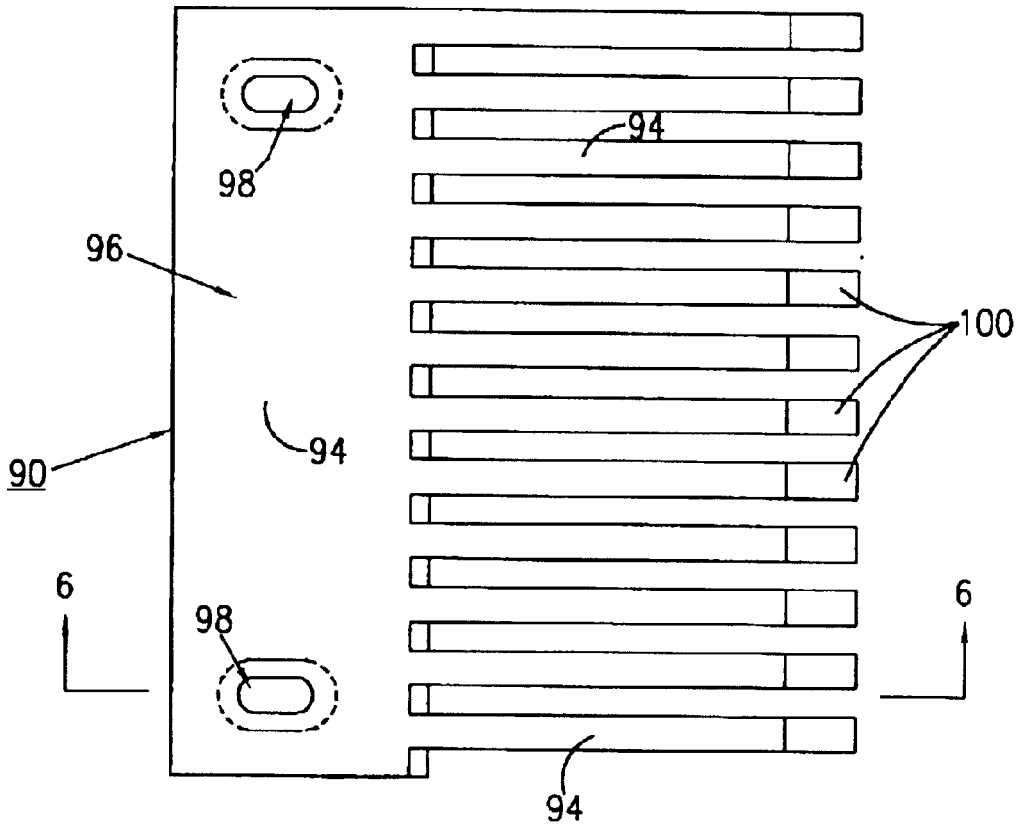
FIG. 5 is a front elevational view of a debris cleaning comb employed by the twin-shaft comminutor shown in FIGS. 2 and 4.
Figure 6:
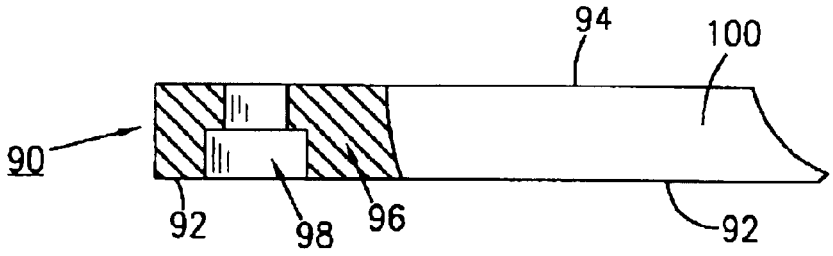
FIG. 6 is a cross-sectional view of the cleaning comb of FIG. 5 taken along section line 6—6 and looking in the direction of the arrows.

As shown in FIGS. 2, 3 and 4, the cutter stacks 62, 72 have different cutter diameters. More particularly, the cutter stack 72 has a larger cutter diameter than the cutter stack 62. By way of example, the cutter stack 62 has a diameter of approximately 4¾ inches and the cutter stack 72 has a diameter of approximately 10 inches. Additionally, the cutter stacks 62, 72 rotate at different speeds relative to each other. By way of example, the cutter stack 62 rotates at an approximate speed of 60 rpm and the cutter stack 72 rotates at an approximate speed of 10 rpm.

Still referring to FIGS. 2, 3 and 4, each of the cutting tips 64 from the smaller cutter stack 62 intermeshes with the opposing cutting tips 74 from the larger cutter stack 72, such that there is a large free area 82 through which solid waste material can flow. It should be noted that because the smaller cutter stack 62 rotates at a higher speed than the larger cutter stack 72, it is the smaller cutter stack 62 that is doing the shredding and cutting of the waste material, while the larger cutter stack 72 is essentially idling at a relatively slow speed such as about 10 rpm. Thus, the power consumption of the comminutor 10 is maintained at a level which is about the same as that of a comminutor using two cutter stacks having diameters similar to the diameter of the cutter stack 62. The result is a twin-shaft comminutor 10 having dissimilar cutter stack diameters that provides efficient power consumption and effective particle size reduction with an added benefit of an intrinsically open design of the opposing cutter stacks 62, 72 for handling higher waste liquid flow rates through the comminutor 10.

As shown in FIGS. 1 and 4, the front opening 28 includes a pair of opposing in-flow debris deflecting combs 84*a* and 84*b* for preventing the ingress of waste material debris at opposing outer sides 86*a* and 86*b* of the front opening 28 of housing 12. The deflecting comb 84*a* is connected to the side wall 18. The deflecting comb 84*b* is similarly connected to the side wall 20, as depicted in FIG. 1. Alternatively, a solid deflector can be used in place of the deflecting combs 84*a* and 84*b*.

As shown in FIGS. 2, 4, 5 and 6, the rear opening 30 includes a strategically positioned cleaning comb 90 extending vertically between the top and bottom sections 14 and 22 of the housing 12. The cleaning comb 90 includes a front side 92, a rear side 94, a mounting section 96 having mounting openings 98 therein, and a plurality of comb teeth 100. The cleaning comb 90 is specifically placed behind the spacer members 76 at the rear opening 30 (see FIG. 4), thereby inhibiting blockage of a plurality of open areas 102 (see FIG. 3) between each of the cutter disks 70 while not itself interfering with or blocking the flow. The front side 92 of the comb teeth 100 is used to assure that the open areas 102 between the larger cutter disks 70 are kept clear of debris in order for the high waste material flow to freely pass through the openings 28 and 30, as shown in FIG. 4. The cleaning comb 90 is attached to a mounting bar 102 having a pair of mounting brackets 104*a* and 104*b* for attachment to the top and bottom sections 14 and 22, respectively, of housing 12, as depicted in FIG. 2. If desired, multiple cleaning combs may be employed or no cleaning combs may be employed.

In operation, the twin-shaft comminutor 10 operates in the following manner. An in-flow of waste material liquid is received within the front opening (area) 28 of the comminutor 10, as shown in FIGS. 1 and 4, the waste material debris impacts upon the rotating cutter stacks 62 and 72. The gear train 48 enables the cutter stacks 62, 72 to rotate in opposite directions to each other (see FIG. 4), such that the cutter stack 62 rotates in a counter clock-wise direction and cutter stack 72 rotates in a clockwise direction. The cutting tips 64, 74 of the rotating cutter stacks 62, 72 shred the waste material sufficiently to permit the throughput of smaller particles through the open areas 66, 82 and 102, whereby the smaller particles of waste material flow freely through the rotating cutter stacks 62, 72 and the outflow of waste material is discharged from the rear opening 30 of comminutor 10 (see FIG. 4). Waste material throughput can be enhanced further by offsetting the cutter stack 62 relative to the cutter stack 72, such as by the distance (F) in FIG. 4. The comb teeth 100 of the cleaning combs 90 are used to keep the open areas 102 between the larger cutter disks 70 of cutter stack 72 free and clear of waste material debris in order for the high waste material flow to freely pass through openings 28 and 30, as depicted in FIG. 4, for enhancing the flow capacity of comminutor 10.

Figure 8:
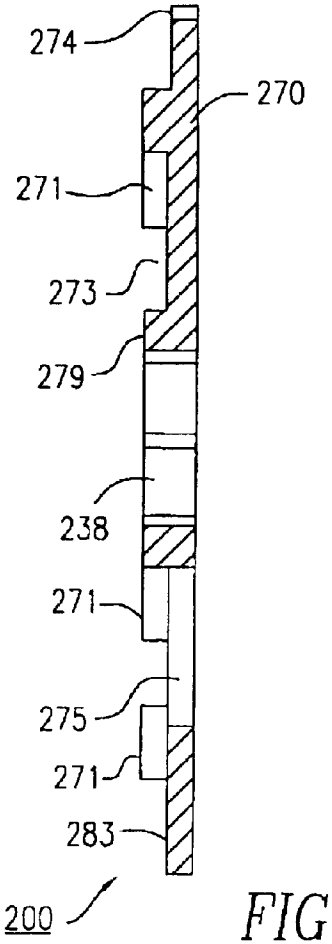
FIG. 8 is a cross-sectional view of the modified cutter disk of FIG. 7 taken along section lines 8—8 and looking in the direction of the arrows.
Figure 7:
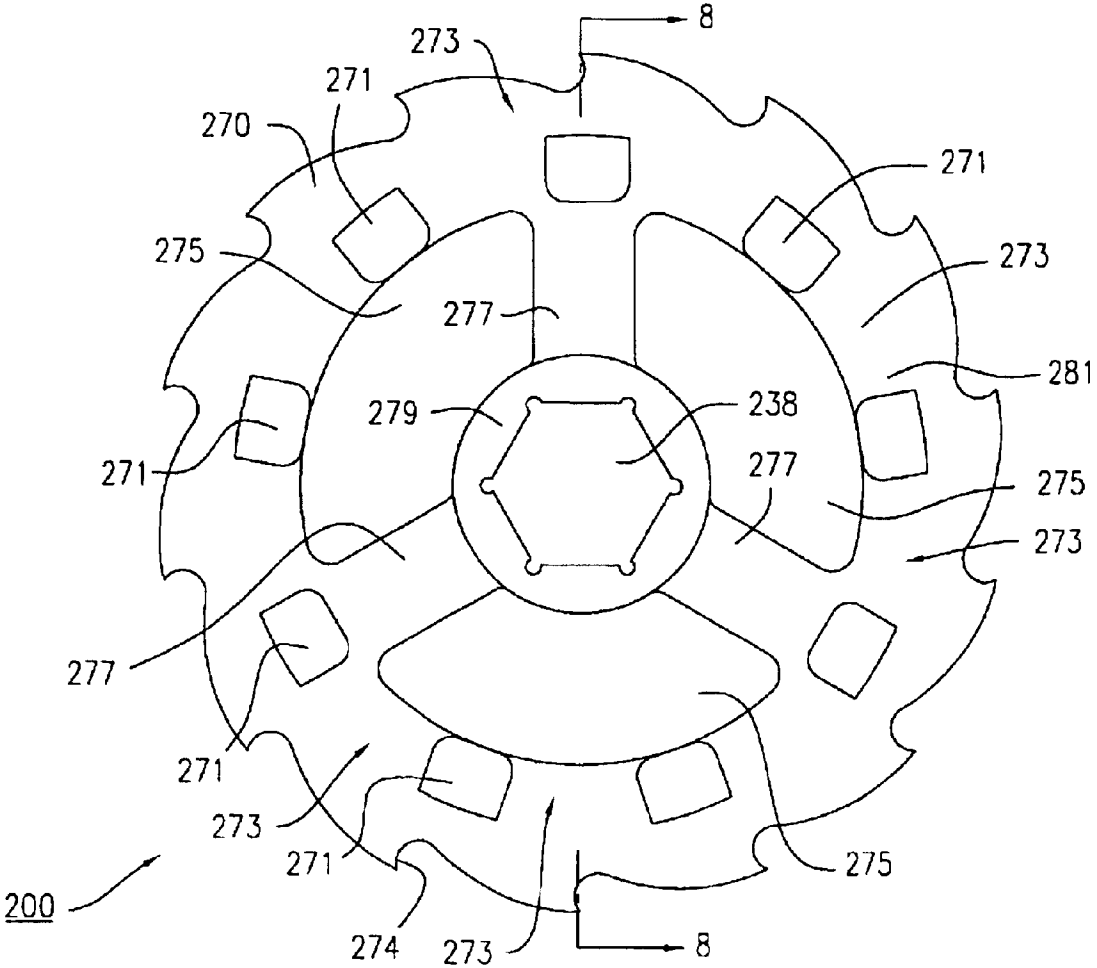
FIG. 7 is a front elevational view of a modified cutter disk that may be employed by the comminutor shown in FIGS. 1 through 4.

FIGS. 7 and 8 depict a modified cutter disk 270 that may be employed by the comminutor shown in FIGS. 1 through 4. Elements illustrated in FIGS. 7 and 8 which correspond, either identically or substantially, to the elements described above with respect to the embodiment of FIGS. 1–4 have been designated by corresponding reference numerals increased by two hundred. Unless otherwise stated, the embodiment of FIGS. 7 and 8 is constructed and assembled in the same basic manner as the embodiment of FIGS. 1–4.

Referring to FIGS. 7 and 8, a cutter disk 270 is shown which is a modified version of the cutter disk 70 shown in FIGS. 1–4. Unlike the cutter disk 70 of FIGS. 1–4, the cutter disk 270 is provided with a plurality of studs 271 projecting in a concentric circle along a rim 281 of one face 283 of the cutter disk 270. Spaces 273 are formed between the studs 271 for the purpose of allowing ground debris and liquid effluent to pass therethrough. The cutter disk 270 further includes a plurality of spokes 277 and apertures 275. The apertures 275 are disposed through the cutter disk 270 and are located adjacent to the spokes 277.

The studs 271 function as a rigid support for any similar or dissimilar cutter disks that are stacked on top of the cutter disk 270. When used in combination with one or more of the unitary cutter body members 60, shown in FIGS. 1–4, the studs 271 also function as anvils in the following manner. With the unitary cutter body member 60 rotating in close proximity to the studs 271, any matter in the space 273 projecting out past the stud 271 is acted on by the unitary cutter body member 60. More particularly, the unitary cutter body member 60 cuts the matter by forcing it against the stud 271 and breaking it into smaller pieces, thus enhancing the grinding operation.

The apertures 275 reduce friction between the cutters 270 when the cutters 270 are arranged in a stack by allowing debris to pass more freely through and between the stacked cutters. The apertures 275 also provide a significant weight reduction over solid cutter disks like the cutter disks 70 of FIGS. 1–4. By reducing the weight of the cutter disk 270 less energy is required to rotate it.

Figure 9:
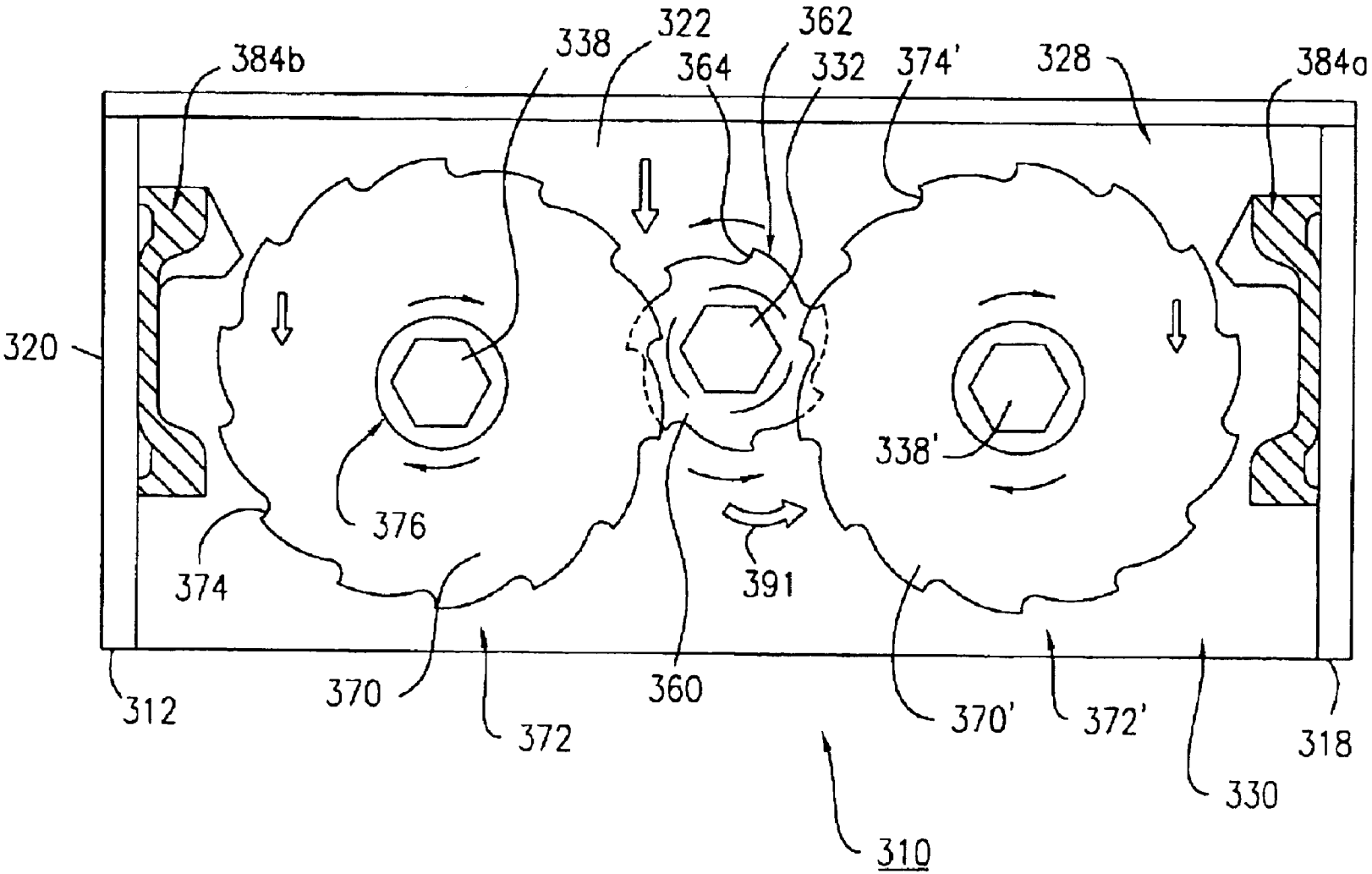
FIG. 9 is a cross-sectional view of a triple-shafted comminutor constructed in accordance with another embodiment of the present invention.

FIG. 9 depicts a three-shafted comminutor constructed in accordance with the present invention. Elements illustrated in FIG. 9 that correspond, either identically or substantially, to the elements described above with respect to the embodiment of FIGS. 1–4 have been designated by corresponding reference numerals increased by three hundred. Unless otherwise stated, the embodiment of FIG. 9 is constructed and assembled in the same basic manner as the embodiment of FIGS. 1–4.

Referring to FIG. 9, a comminutor system 310 includes a substantially rectangularly-shaped housing 312 having side walls 318 and 320, and a bottom base section 322. The housing 312 includes a front opening 328 for receiving an in-flow of waste material liquid and a rear opening 330 for discharging an out-flow of waste material. A debris deflecting comb 384*a* is affixed to a side 318 of housing 312. Similarly, another debris deflecting comb 384*b* is affixed to an opposing side 320 of housing 312. The bottom base section 322 serves as a mounting point for three rotatable cutter shafts 338, 332 and 338'.

The shaft 338' is vertically oriented and mounted parallel to the other rotatable shafts 338 and 332, which are basically the same as the shafts 38 and 32, respectively, of FIGS. 1–4. Disposed upon the rotatable shafts 338, 332 and 338' are a plurality of cutter disks 370, 360 and 370', respectively, forming cutter stacks 372, 362 and 372', respectively. In relation to the front opening 328 of the comminutor 310, shaft 338 rotates clockwise, shaft 332 rotates counterclockwise and shaft 338' rotates clockwise. While the cutter disks 370, 360 of the cutter stacks 372, 362, respectively, function in a manner similar to their counterparts in the embodiment of FIGS. 1–4, the cutter disks 370' of cutter stack 372' provide a novel backside cutting feature to the comminutor system 310.

During operation, some solid materials may pass through or between cutting disks 370 and 360 without being ground or shredded. These solid materials are captured by the turbulent rotating motion of the liquid effluent generated by the cutter disks 360 and conveyed into the cutter disks 360 and 370', as shown by arrow 391. As these solid materials are conveyed back into the cutter disks, 360 and 370', they are ground and shredded on the backside or outlet side of the wastewater stream. This backside cutting feature is unique to the triple-shaft grinder embodiment 310 and enhances the grinding function by grinding materials that have already passed through the initial grinding stage and would have passed downstream unprocessed.

Rotational motion may be provided to the shafts 338, 332 and 338' by a single motor in cooperation with a gear train connected directly to the shafts 338, 332 and 338'. Alternatively, rotational motion may be provided by a plurality of motors, not shown, connected to two or more shafts either directly or in cooperation with a gear train or similar gearing system.

Figure 10:
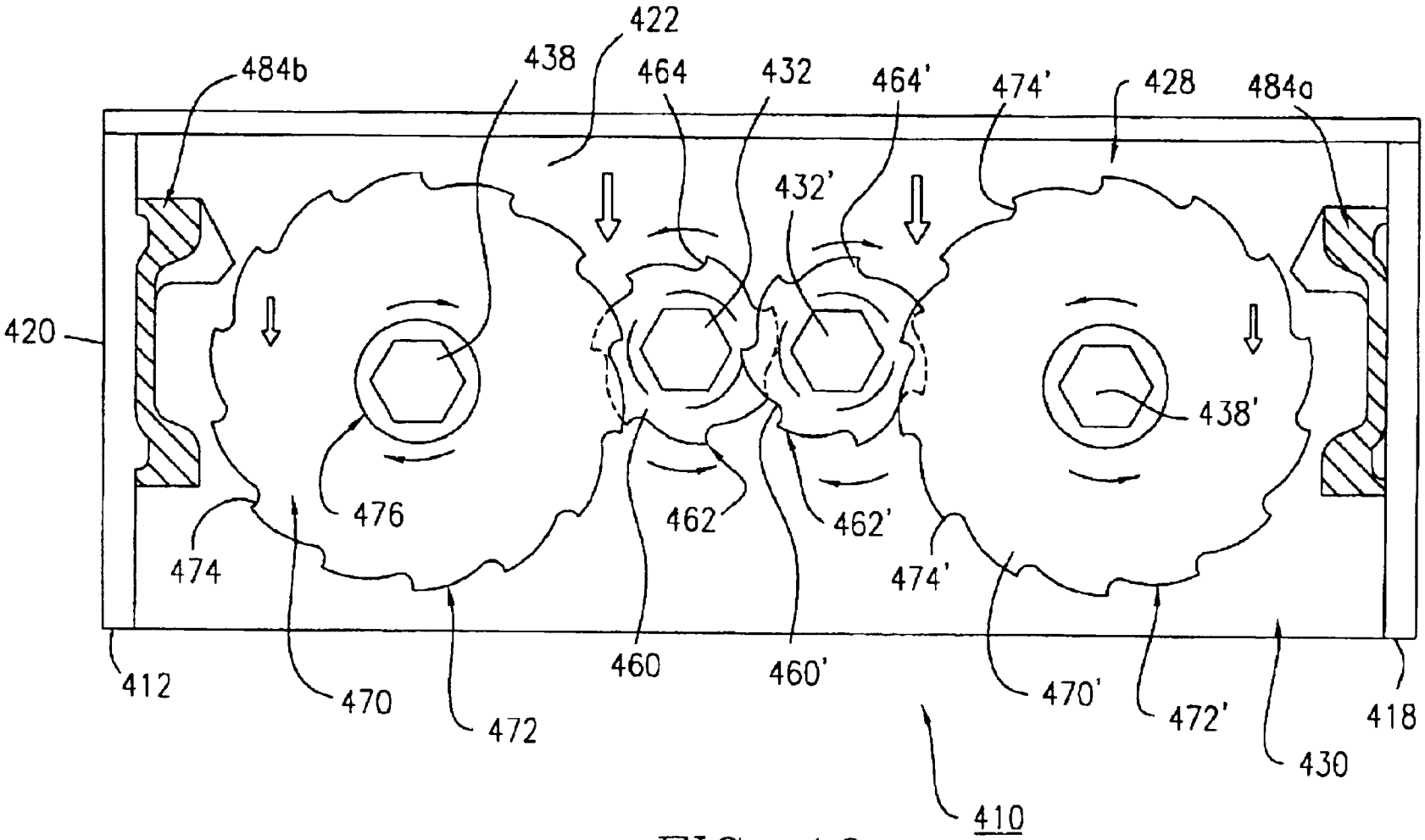
FIG. 10 is a cross-sectional view of a four-shafted of a comminutor constructed in accordance with yet another embodiment of the present invention.

FIG. 10 depicts a four-shafted comminutor constructed in accordance with the present invention. Elements illustrated in FIG. 10 that correspond, either identically or substantially, to the elements described above with respect to the embodiment of FIGS. 1 through 4 have been designated by corresponding reference numerals increased by four hundred. Unless otherwise stated, the embodiment of FIG. 10 is constructed and assembled in the same basic manner as the embodiment of FIGS. 1–4.

Referring to FIG. 10, a comminutor system 410 includes a substantially rectangularly-shaped housing 412 having side walls 418 and 420, and a bottom base section 422. The housing includes a front opening 428 for receiving an in-flow of waste material liquid and a rear opening 430 for discharging an out-flow of waste material. A debris deflecting comb 484*a* is affixed to a side 418 of housing 412. Similarly, another debris deflecting comb 484*b* is affixed to an opposing side 420 of housing 412. The bottom base section 422 serves as a mounting point for four rotatable cutter shafts 438, 432, 438' and 432'.

The shafts, 438' and 432', are vertically oriented and mounted parallel to the other rotatable shafts 438 and 432, which are basically the same as the shafts 38 and 32, respectively, of FIGS. 1–4. Disposed upon the rotatable shafts 438, 432, 438' and 432' are a plurality of cutter disks 470, 460, 470' and 460', respectively, forming cutter stacks 472, 462, 472' and 462', respectively. In relation to the front opening 428 of the comminutor 410, shaft 438 rotates clockwise, shaft 432 rotates counterclockwise, shaft 438' rotates counterclockwise and shaft 432' rotates clockwise.

The four-shaft comminutor embodiment allows for twice the flow and grinding capacity of that of the twin-shaft comminutor embodiment of FIGS. 1–4. The four-shaft comminutor embodiment weighs less than the combined weight of two twin-shaft comminutors. Larger sewer and waste water channels that previously required two separate twin-shaft comminutors of the embodiment depicted in FIGS. 1–4 can be served by one unit constructed according to this embodiment.

Rotational motion may be provided to the shafts 438, 432, 438' and 432' by a single motor in cooperation with a gear train connected directly to the shafts 438, 432, 438' and 432'. Alternatively, rotational motion may be provided by a plurality of motors, not shown, connected to two or more shafts either directly or in cooperation with a gear train or similar gearing system.

Figure 11:
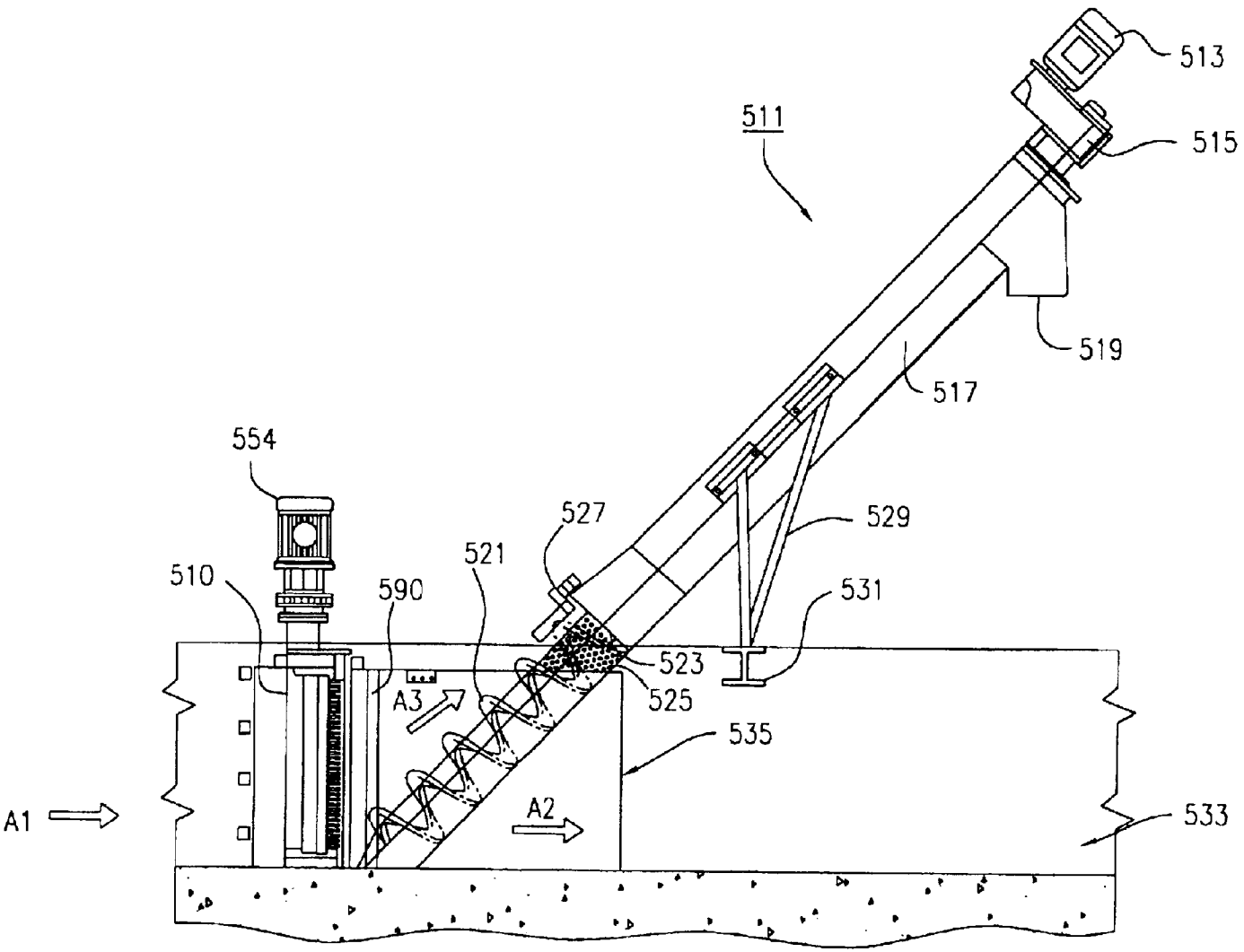
FIG. 11 is a partial cross-sectional view of a twin-shafted comminutor constructed in accordance with a still further embodiment of the present invention.
Figure 12:
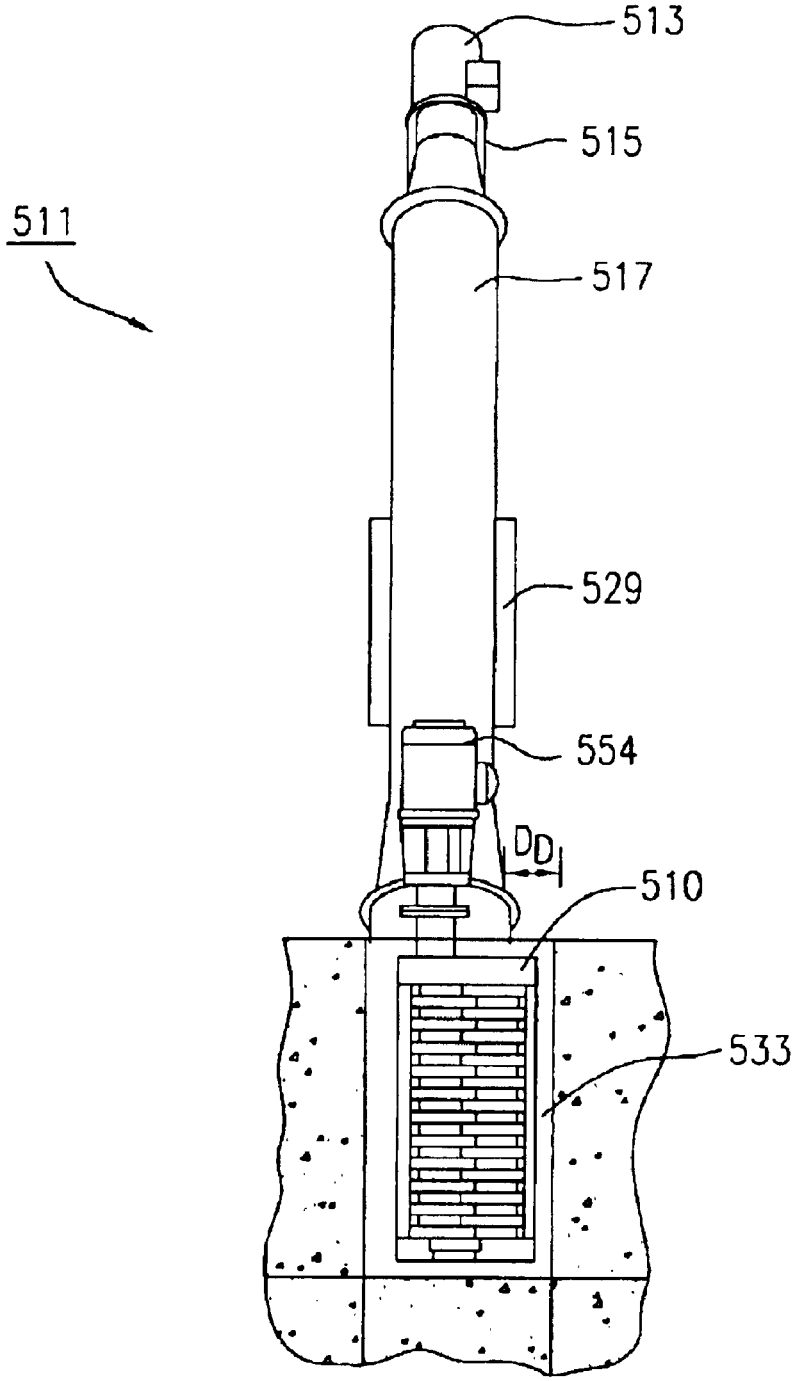
FIG. 12 is a partial cross-sectional side view of the comminutor depicted in FIG. 11.
Figure 13:
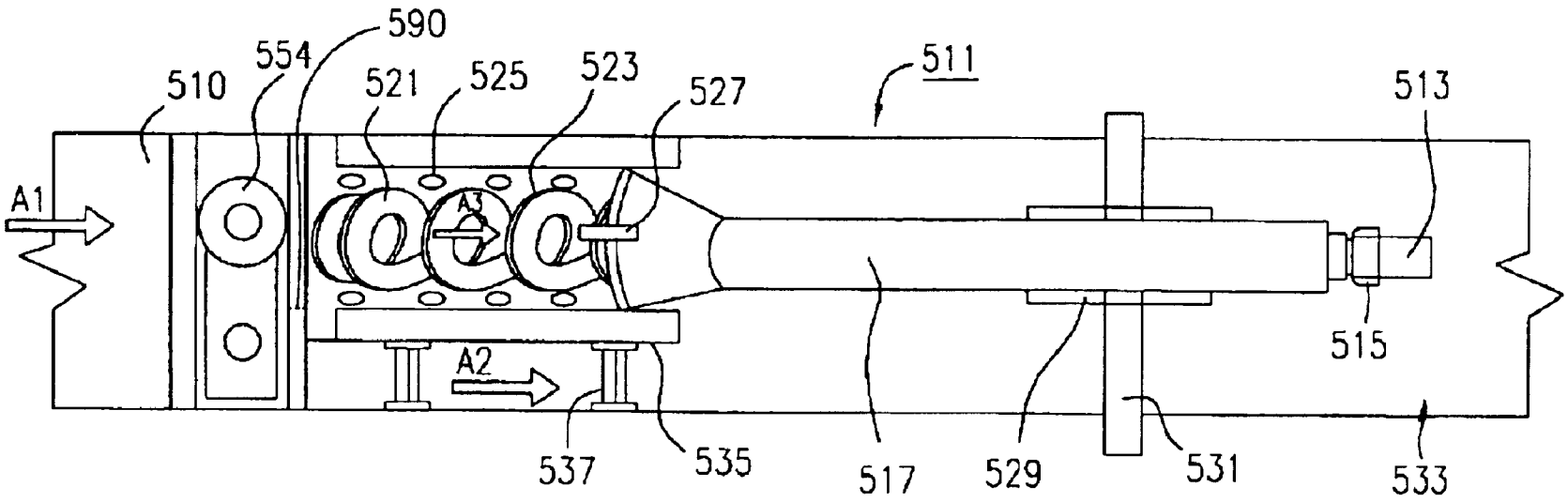
FIG. 13 is a top plan view of the comminutor depicted in FIG. 11.

FIGS. 11–13 depict a fifth embodiment of the present invention. Elements illustrated in FIGS. 11–13 that correspond, either identically or substantially, to the elements described above with respect to the embodiment of FIGS. 1–4 have been designated by corresponding reference numerals increased by five hundred. Unless otherwise stated, the embodiment of FIGS. 11–13 is constructed and assembled in the same basic manner as the embodiment of FIGS. 1–4.

Referring to FIGS. 11–13, a comminutor system 510 is shown which is the same as the embodiment shown in FIGS. 1–4, except for the addition of an auger screen assembly 511. The auger screen assembly 511 includes a motor 513 for powering the auger screen assembly 511. The motor 513 is connected to a hollow shaft reduction gearbox 515. The hollow shaft reduction gearbox 515 is affixed to a transport tube 517. A discharge chute 519 is disposed in the transport tube 517, which may be a cylindrical tube surrounding a portion of a shaftless screw auger 521. The transport tube 517 is affixed to a screen basket 523. The screen basket 523 is trough shaped and has a plurality of perforations 525 disposed within it. The screen basket 523 partially surrounds the shaftless screw auger 521, which is disposed within both the screen basket 523 and transport tube 517. The shaftless screw auger 521 is connected to the motor 513 through the gearbox 515. A spray nozzle 527 is affixed to the transport tube 517. Support brackets 529 are attached between the transport tube 517 and a support beam 531 located in a channel 533.

A divider plate 535 is located in the channel 533 and mounted on one side of the screen basket 523. The divider plate 535 extends from the comminutor system 510 and runs parallel to the downstream flow. Within the channel 533 are a plurality of divider supports 537 which support the divider plate 535 and are affixed between the divider plate 535 and the channel 533.

During operation, the auger screen assembly 511 is positioned to convey effluent away from the downstream side of the comminutor system 510, which includes a cleaning comb 590. The cleaning comb 590 acts act together with the divider plate 535 to segregate "solid containing flow" from the "clear flow" which bypasses the auger screen assembly 511. Solid materials that pass through the comminutor assembly 510 flow into the auger screen assembly 511 and are deposited on the shaftless screw auger 521. The direction of flow is indicated by the arrow A1 of FIG. 11. The shaftless screw auger 521 rotates in a direction that moves both solids and liquids up and away from grinders 514 in the direction represented by arrow A3. Much of the liquid traveling through the effluent channel 533 flows past the auger screen assembly 511 separated by the divider 535, as represented by Arrow 2 of FIG. 13. Some liquid passing through the comminutor assembly 510 flows into the auger screen assembly 511. Liquid that travels into the auger screen assembly 511 passes through the perforations 525 in the screen basket 523 and into the downstream side of the effluent flow represented by arrow A2 of FIG. 11. Spray nozzle 527 sprays water onto the solid materials deposited on the shaftless screw auger 521 to remove adhering organic debris from the solid materials as they move up the shaftless screw auger 521. The solid materials are transported up the shaftless screw auger 521 through the transport tube 517. The transport tube 517 prevents material transported by the shaftless screw auger 521 from falling out of the auger screen assembly 511 before reaching the discharge chute 517. After passing through the transport tube 517 the solid materials reach the discharge chute 519. The discharge chute 519 expels the solid materials from the auger screen assembly 511.

It should be understood that the embodiments described herein are merely exemplary and that a person skilled in the art may make many variations and modifications without departing from the spirit and scope of the invention. All such variations and modifications are intended to be included within the scope of the invention as defined in the appended claims.

What is claimed is:

1. A comminutor apparatus, comprising:

a housing having a channel adapted to receive a liquid containing waste products, said channel having an upstream end and a downstream end relative to liquid flow through said channel;

a first shaft rotatably mounted within said channel between said upstream end and said downstream end in a substantially upright position normal to said channel;

a first set of cutter disks having a first diameter, said first set of cutter disks being mounted on said first shaft for conjoint rotation therewith;

a second shaft rotatably mounted within said channel between said upstream end and said downstream end in a substantially upright position normal to said channel;

a second set of cutter disks having a second diameter, which is greater than said first diameter of said first set of cutter disks, said second set of cutter disks being mounted on said second shaft for conjoint rotation therewith, said cutter disks of said second set of cutter disks being interleaved with said cutter disks of said first set of cutter disks such that said cutter disks of said second set of cutter disks are positioned proximate to said first shaft and such that said cutter disks of said first set of cutter disks are positioned remote from said second shaft, whereby relatively large, open areas are created between said first set of cutter disks and said second shaft so as to promote flow of liquid through said channel from said upstream end toward said downstream end; and rotating means for rotating said first shaft and said second shaft.

2. A comminutor apparatus in accordance with claim 1, wherein said first shaft rotates in an opposite direction relative to second shaft, whereby said first set of cutter disks rotates in an opposite direction relative to said second set of cutter disks.

3. A comminutor apparatus in accordance with claim 2, wherein said first shaft is spaced from said upstream end of said housing by a first distance and said second shaft is spaced from said upstream end of said housing by a second distance which is greater than said first distance.

4. A comminutor apparatus in accordance with claim 3, wherein said rotating means rotates said first shaft at a different rotational speed than said second shaft, whereby said first set of cutter disks rotates at a different rotational speed than said second set of cutter disks.

5. A comminutor apparatus in accordance with claim 4, wherein said first shaft rotates faster than said second shaft, whereby said first set of cutter disks rotates faster than said second set of cutter disks.

6. A comminutor apparatus in accordance with claim 5, wherein said rotating means includes an electric motor.

7. A comminutor apparatus in accordance with claim 5, wherein said rotating means includes a hydraulic motor.

8. A comminutor apparatus in accordance with claim 1, further comprising conveying means, mounted adjacent said downstream end of said housing, for conveying solid matter away from said first and second sets of cutter disks.

9. The comminutor apparatus of claim 8, wherein said conveying means includes an auger screen assembly.

10. The comminutor apparatus of claim 8, further comprising a cleaning comb positioned between said conveying means and said downstream end of said housing, said cleaning comb having a plurality of teeth interleaved with said second set of cutter disks, whereby said cleaning comb removes solid matter from said second set of cutter disks and channels it into said conveying means.

11. The comminutor apparatus of claim 1, further comprising a cleaning comb positioned adjacent said downstream end of said housing, said cleaning comb having a plurality of teeth interleaved with said second set of cutter disks, whereby said cleaning comb removes solid matter from said second set of cutter disks.

12. The comminutor apparatus of claim 1, wherein each cutter disk of said second set of cutter disks has at least one planar face and a plurality of studs extending from said at least one planar face and a plurality of studs extending from said at least one planar face toward an adjacent cutter disk of said second set of cutter disks.

13. The comminutor apparatus of claim 12, wherein each cutter disk of said second set of cutter disks has a plurality of apertures disposed in said at least one planar face thereof.

14. The comminutor apparatus of claim 1, further comprising a third shaft rotatably mounted within said housing between said upstream and said downstream ends thereof; and a third set of cutter disks mounted on said third shaft for conjoint rotation therewith, each of said cutter disks of said third set of cutter disks having a third diameter which is substantially the same as said second diameter.

15. The comminutor apparatus of claim 14, wherein said third shaft rotates in the same direction as said second shaft, whereby said third set of cutter disks rotates in the same direction as said second set of cutter disks.

16. The comminutor apparatus of claim 15, wherein said second shaft is mounted on one side of said first shaft and said third shaft is mounted on an opposite side of said first shaft.

17. The comminutor apparatus of claim 1, further comprising a third shaft rotatably mounted within said housing between said upstream and said downstream ends thereof; a third set of cutter disks mounted on said third shaft for conjoint rotation therewith, each of said cutter disks of said third set of cutter disks having a third diameter which is substantially the same as said second diameter; a fourth shaft rotatably mounted within said housing between said upstream and said downstream ends thereof; and a fourth set of cutter disks mounted on said fourth shaft for conjoint rotation therewith, each of said cutter disks of said fourth set of cutter disks having a fourth diameter which is substantially the same as said first diameter.

* * * * *